United States Patent [19]

Kennard, Jr. et al.

[11] Patent Number: 4,651,884

[45] Date of Patent: Mar. 24, 1987

[54] PORTABLE AND COLLAPSIBLE DERRICK STRUCTURE

[76] Inventors: Dwight C. Kennard, Jr., 3830 Incochee Trail, Traverse City, Mich. 49684; James C. Kennard, P.O. Box 76, Maple City, Mich. 49664

[21] Appl. No.: 723,364

[22] Filed: Apr. 15, 1985

Related U.S. Application Data

[63] Continuation-in-part of Ser. No. 621,154, Jun. 15, 1984, Pat. No. 4,615,450.

[51] Int. Cl.[4] ..... B66C 23/42

[52] U.S. Cl. ..... 212/183; 212/186; 52/116; 52/120

[58] Field of Search ..... 212/182, 183, 185, 186, 212/187, 188, 239, 262, 256; 52/113, 114, 116, 117, 120

[56] References Cited

U.S. PATENT DOCUMENTS 2,259,966 10/1941 Tappe ..... 212/187
2,583,958 1/1952 Moon ..... 52/116

FOREIGN PATENT DOCUMENTS 568609 3/1924 France ..... 212/256
176667 11/1965 U.S.S.R. ..... 212/239

*Primary Examiner*—Trygve M. Blix
*Assistant Examiner*—Thomas J. Brahan
*Attorney, Agent, or Firm*—Price, Heneveld, Cooper, DeWitt & Litton

[57] ABSTRACT

A pickup truck derrick assembly includes a base frame, a derrick A-frame pivotally mounted on the base frame, a derrick frame erection subassembly, a frame support and locking subassembly and a cable compensation system. In one form, the frame erection subassembly includes an elongated track. A roller or carriage subassembly rides on the track and engages the A-frame. Movement of the carriage along the track raises and lowers the A-frame. The A-frame is held in an erected position by support braces pivotally connected at one end to the base frame. Each brace slidably engages a sleeve mounted on the A-frame. A locking mechanism automatically secures the braces to the sleeves when the A-frame is erected. In another form, the erection subassembly includes lead screw actuators combined with the support braces to raise and lower the A-frame and lock the frame in position. A pulley and cable arrangement including a compensation pulley on a support arm fixed to the A-frame compensates for hoist cable slackening when the A-frame is pivoted to its storage position.

12 Claims, 12 Drawing Figures

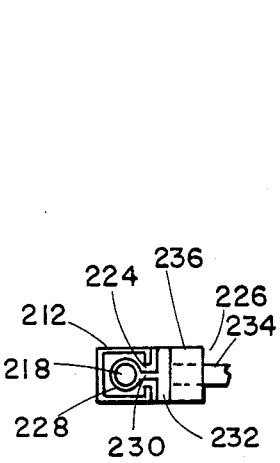
FIG 12
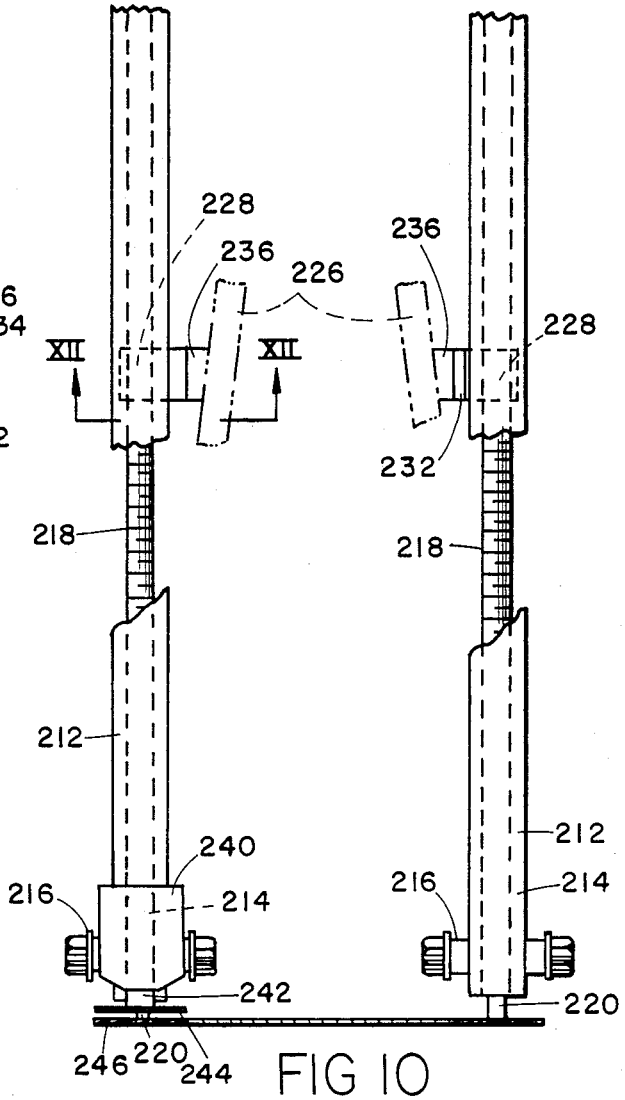
FIG 10
FIG 11
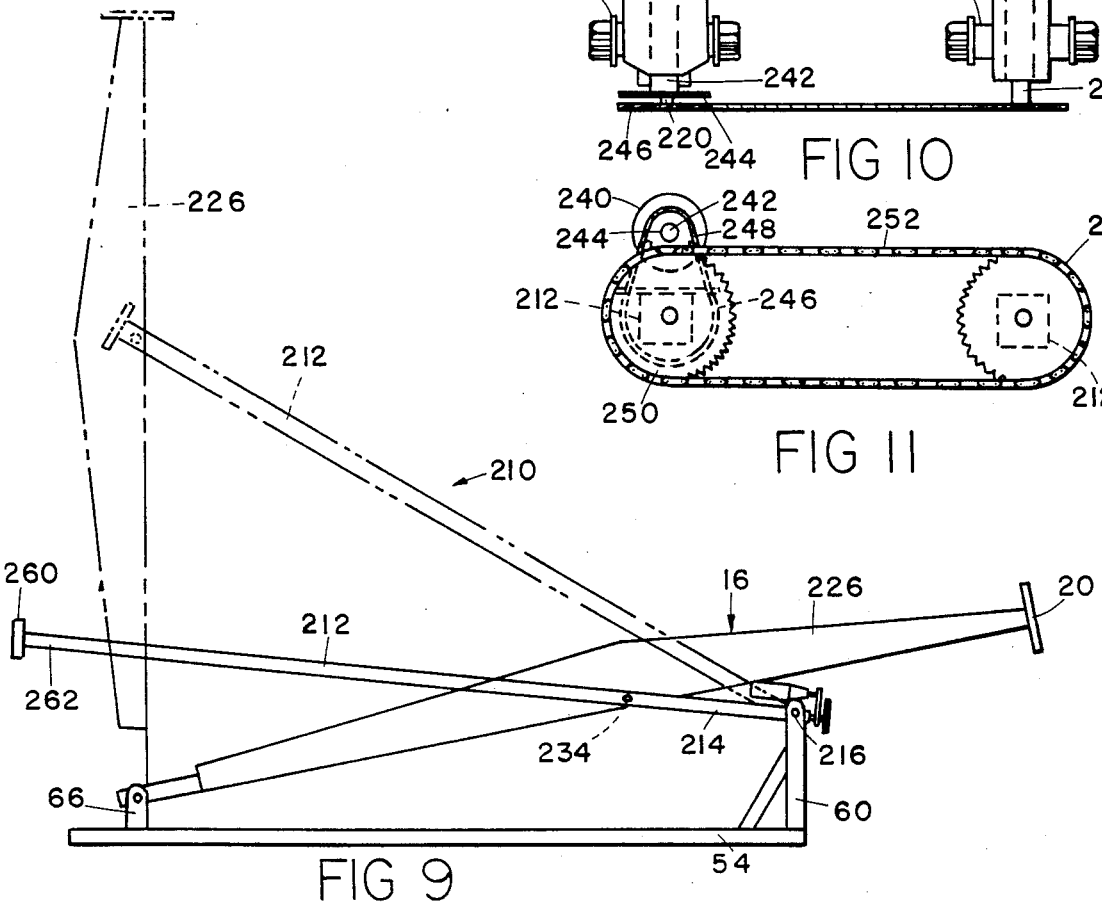
FIG 9

PORTABLE AND COLLAPSIBLE DERRICK STRUCTURE

CROSS REFERENCE TO RELATED APPLICATION

This application is a continuation-in-part of copending application Ser. No. 06/621,154 filed June 15, 1984, now U.S. Pat. No. 4,615,450.

BACKGROUND OF THE INVENTION

This invention relates to a collapsible support assembly and, more particularly, to improvements in a portable, collapsible derrick structure.

In various operations, such as building construction, boat launching and general warehouse moving, a need exists for a temporary hoist which can be transported to the work site, is quickly and easily erected from a collapsed, transporting position to an erected, operating position and is very stable during use. Several truck mounted arrangements are available which have an erectable derrick structure.

A portable assembly is shown in U.S. Pat. No. 4,068,762 entitled PICKUP TRUCK DERRICK, issued Jan. 17, 1978 to the present inventor. This patent discloses a collapsible boom and derrick hoist assembly having a base frame securable to the side rails of a pickup truck. A collapsible A-frame is pivotally mounted to the front end of the base frame. In the collapsed, folded position, the A-frame rests over the tailgate of the pickup truck. While in the erected position, the A-frame rises above the front end of the truck bed. The assembly also provides a brace for supporting the A-frame when the A-frame is in the erected position.

The hoist assembly includes an A-frame erection system for raising the A-frame to its operating position. In one embodiment, the erection system includes a winch and pulley arrangement located near the truck cab and a subassembly located near the tailgate for increasing the mechanical advantage of the winch. In another embodiment, the A-frame erection system has a pair of U-shaped rails attached to the side rails of the base frame. Each leg of the A-frame is pivotally mounted to a slider assembly which in turn is slidably mounted to the U-shaped rails. Pulling the sliders toward the front of the truck erects the A-frame to its vertical position near the front end of the truck bed.

The hoist assembly includes a foldable, two-piece boom which is supported by the A-frame and which is erected by means of a winch, cable and strut arrangement. The hoist assembly also includes a boom swinging mechanism for rotating the boom about its vertical axis, a boom elevating system for raising and lowering the boom and a hoisting system for lifting a load.

U.S. Pat. No. 3,059,781 to Bender, entitled MATERIAL HANDLING DEVICE, issued Oct. 23, 1962 discloses a derrick elevating mechanism having a roller type structure. The elevating mechanism has a track spanned by a hydraulic powered roller assembly. A connecting arm extends between the roller assembly and a pivotal mast. Actuation of the hydraulic ram draws the roller up the track, causing the connecting arm to pivot the mast from a horizontal to a vertical position.

U.S. Pat. No. 3,797,672 to Vermette, entitled APPARATUS ATTACHABLE TO A TRUCK BODY OR THE LIKE FOR USE FOR HOISTING OR LIFTING, OR AS AN ELEVATED SUPPORT, issued on Mar. 19, 1974 discloses a latching mechanism used to lock a support brace to a derrick frame. The latching mechanism includes an upright auxiliary support brace having attached thereto an upper spring activated latch and a lower, gravity activated latch. As the derrick frame is raised to its elevated position, the upper latch engages the pin attached to the derrick to secure the derrick to the upright support. Simultaneously, the lower latch engages another pin attached to the derrick frame to lock the derrick in the upright position. In this arrangement, the operator must actually handle the latch mechanism to disengage it when it is in an upright position. Thus, the latch mechanism must be located near the base of the derrick frame so as to be within reach of the operator. Consequently, additional support braces and/or support wires must be used to support the upper portions of the derrick frame.

In the above derrick assemblies which include a hydraulic ram, the derrick erection system is connected to the derrick near the derrick pivot point. Consequently, considerable amounts of force must be developed by the erection assembly because the load on the ram is very high during the initial movement of the derrick due to the positioning of the erection system with respect to the derrick. In addition, in assemblies having a derrick fixed and pivoted to the base frame, the hoisting cable shortens due to the cable wrapping around its guide pulleys as the boom and A-frame are lowered. Cable shortening causes the cable to retract, and this retraction can result in the hooked end of the hoisting cable jamming into its guide pulley located at the end of the boom.

Therefore, a need exists for a cable system which will not retract as the derrick and boom are lowered. A need also exists for a brace system which supports the upper portions of the derrick frame, which engages automatically as the derrick is raised and which locks automatically once the derrick is erected. A need also exists for a derrick erection system which does not require auxiliary erection systems or overhead cables and pulleys.

SUMMARY OF THE INVENTION

In accordance with the present invention, an improved, portable derrick assembly is provided which can be raised by a winch and cable system from a collapsed, transporting position to an erected, operating position and which, when erected, can be securely braced and locked in that operating position. Essentially, the collapsible derrick assembly includes a base frame, an A-frame structure pivotally secured to the base frame and a brace leg pivotally secured at one end to the base frame and engaging the A-frame. Provision is made for simultaneously raising both the A-frame and its support brace to an erected, operating position and for securing the A-frame in its erected position. Provision is further made for preventing the hooked end of the hoisting cable from jamming into the guide pulley as the A-frame is lowered.

BRIEF DESCRIPTION OF THE DRAWINGS

FIG. 9 is a side elevation of an alternative A-frame erection subassembly;

FIG. 10 is a fragmentary, top, plan view of the alternative A-frame erection subassembly;

FIG. 11 is an end view of the alternative erection subassembly; and

FIG. 12 is a cross-sectional view taken generally along line XII—XII of FIG. 10.

DETAILED DESCRIPTION OF THE PREFERRED EMBODIMENT

Figure 1:
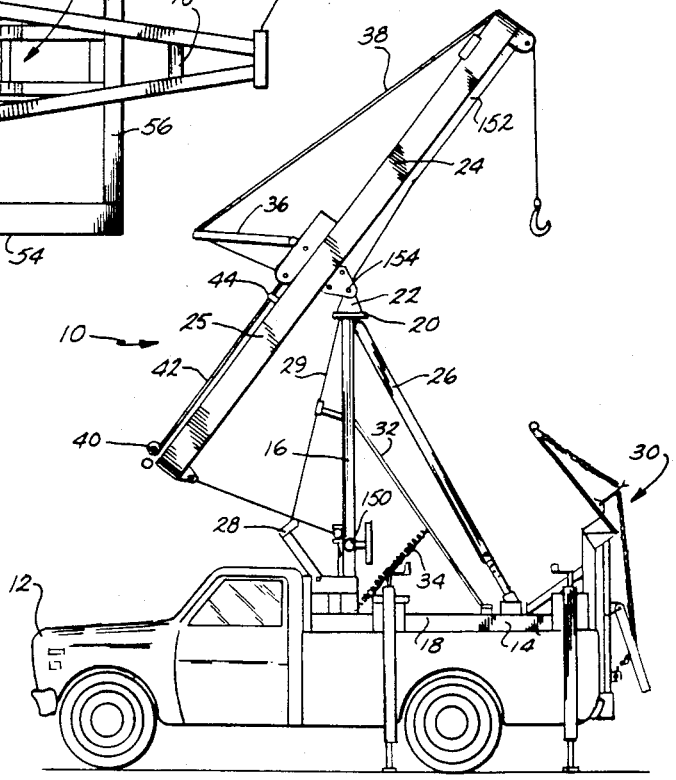
FIG. 1 is a side, elevational view of a pickup truck derrick assembly.

FIG. 1 illustrates a collapsible derrick assembly as disclosed in aforementioned U.S. Pat. No. 4,068,762. As discussed in detail below, the present invention relates to certain improvements in the assembly of FIG. 1. To the extent necessary, the disclosure of U.S. Pat. No. 4,068,762 is hereby incorporated by reference.

In FIG. 1, the assembly is generally designated by the number 10. Assembly 10 is mounted to a conventional pickup truck 12 at side rails 14. The assembly includes a collapsible A-frame 16 pivotally mounted to the front end of a base 18. A boom mounting plate 20 is positioned at the truncated apex of A-frame 16. Plate 20 supports a boom pivot or trunnion assembly 22. Boom sections 24 and 25 are pivotally secured to trunnion assembly 22.

In the collapsed position, A-frame 16 rests over the tailgate of pickup truck 12 while the two sections 24, 25 of the boom fold over the A-frame. In the erected position, A-frame 16 rises above the cab of pickup truck 12 while the two sections 24, 25 of the boom are unfolded and connected together to form a single boom structure. Assembly 10 also includes a pair of telescoping braces 26 which support the A-frame when the A-frame is in the erected position.

Assembly 10 is provided with an erection system for raising the A-frame to its upright position. The erection system includes a differential winch 28 and an overhead cable 29 which is operatively connected to the winch and to the apex of the A-frame. The erection system further includes an auxiliary erecting strut 30 located at the tailgate of truck 12, a pair of chains 32 connected to the A-frame and the base frame and springs 34 attached to the base frame and the chains, all of which are used to increase the mechanical advantage of winch 28.

Derrick assembly 10 is also provided with a boom erection system for erecting the foldable two-piece boom. A main erection strut 36 is pivotally disposed on the hoist member 24 of the boom assembly. A chain 38 extends from the top of the erection strut 36 to a point near the end of the hoist member 24. A winch 40 is disposed on the lower end of counterbalanced portion 25 of the boom assembly. A cable 42 extends from the winch under a guide cable roller 44 to the end of the main erection strut 36.

Assembly 10 is further provided with a hook hoisting mechanism for lifting loads. The structure and operation of the hook hoisting mechanism will be described below in relation to the cable slackening system improvement of the present invention.

FIGS. 2–8 illustrate various improvements to the derrick assembly disclosed in FIG. 1. The improvements include a new derrick frame erection system, a derrick frame support and locking mechanism and a cable slackening compensation system.

DERRICK ERECTION SYSTEM

Figure 2:
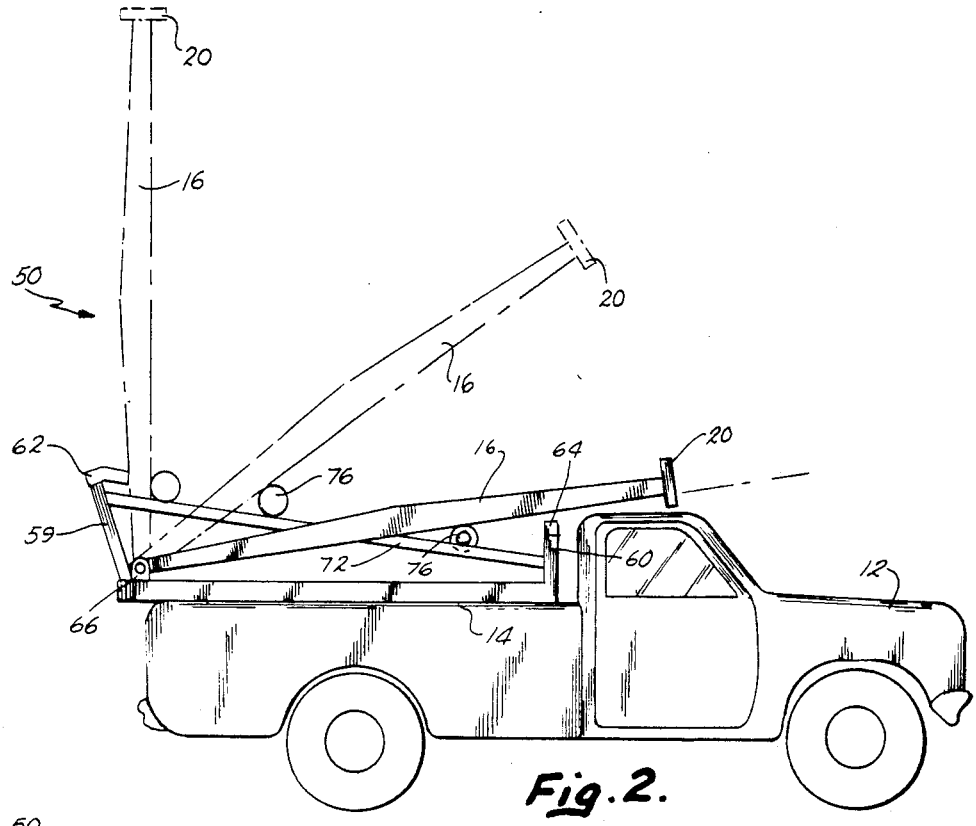
FIG. 2 is a side, elevational view of an A-frame and erection subassembly in accordance with the present invention.
Figure 3:
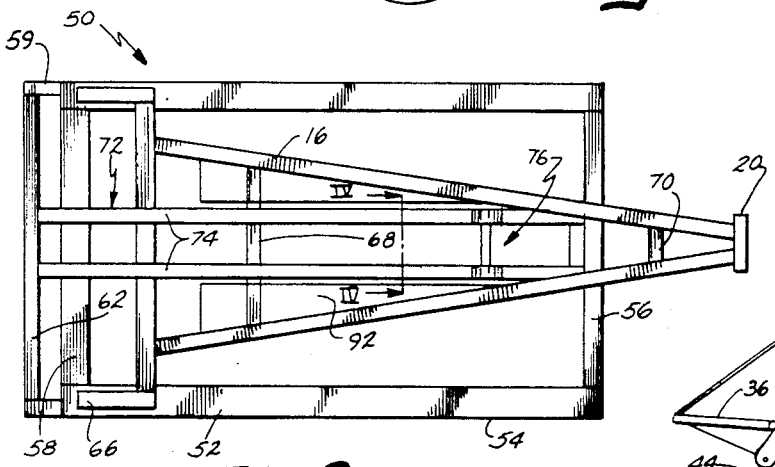
FIG. 3 is a top, plan view of the A-frame and erection subassembly.

FIGS. 2 and 3 illustrate a collapsible derrick assembly in accordance with the present invention and which is generally designated 50. For simplicity and ease of understanding, the boom assembly, hoist cables, support braces and the like as shown in FIG. 1 have not been illustrated. It should be understood that such would be included in the complete derrick.

A base frame or mounting frame 52 of the assembly includes two longitudinal structural members or base members 54 and forward and rear base cross members 56 and 58, respectively. An upper rear cross member 62 is attached to rear struts 59, and an upper front cross member 64 is attached to front struts 60.

A-frame 16 has two legs which converge with each other at the upper end of the A-frame. The lower end of the A-frame is mounted to rear cross member 58 at pivot mountings 66. The two legs of the A-frame are connected to each other by a lower cross brace 68 and an upper cross brace 70. As seen in FIG. 2, A-frame 16 is pivotal from a collapsed, transporting position to an erected, operating position. When the derrick assembly is mounted to a truck, the A-frame, when it is in its transport position, extends over the cab of the pickup truck. When the A-frame is in its erected position, it rises above the tailgate of the pickup truck which positions it to allow for maximum useful reach of the boom.

The raising and lowering of the A-frame is accomplished by the derrick erection system as shown in FIGS. 2, 3, 4 and 5. The system includes a track 72 having a pair of spaced, parallel rails 74 extending from the rear to the front of base frame 52. Preferably, track 72 is inclined by attaching the rear ends of rails 74 to upper rear cross member 62 and the front ends of rails 74 to front base cross member 56. As can be seen in FIG. 2, when the A-frame is in its collapsed position, the rear end of each track 72 lies above the pivoted base of the A-frame, and the front end of each track 72 lies below the legs of the A-frame. Alternatively, the track may be horizontal or curved to change the mechanical advantage obtained.

Figure 4:
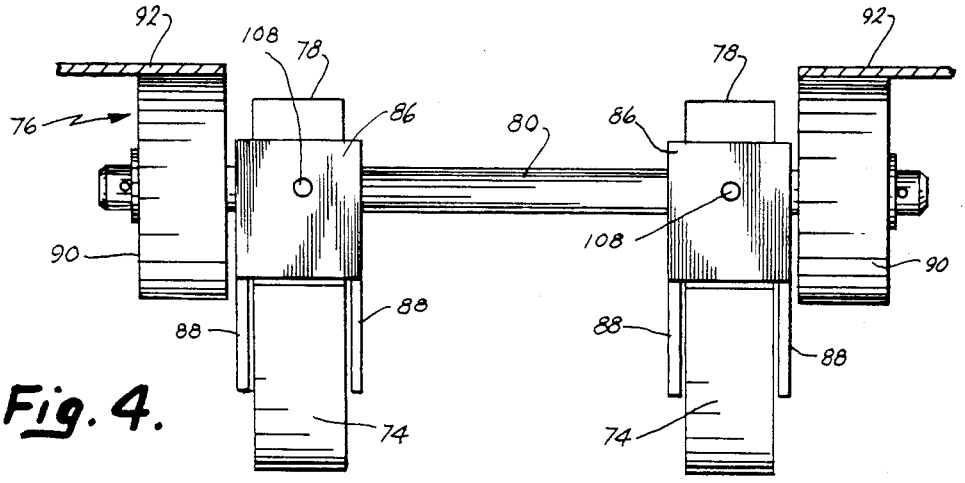
FIG. 4 is a cross-sectional view taken generally along line IV—IV of FIG. 3.
Figure 5:
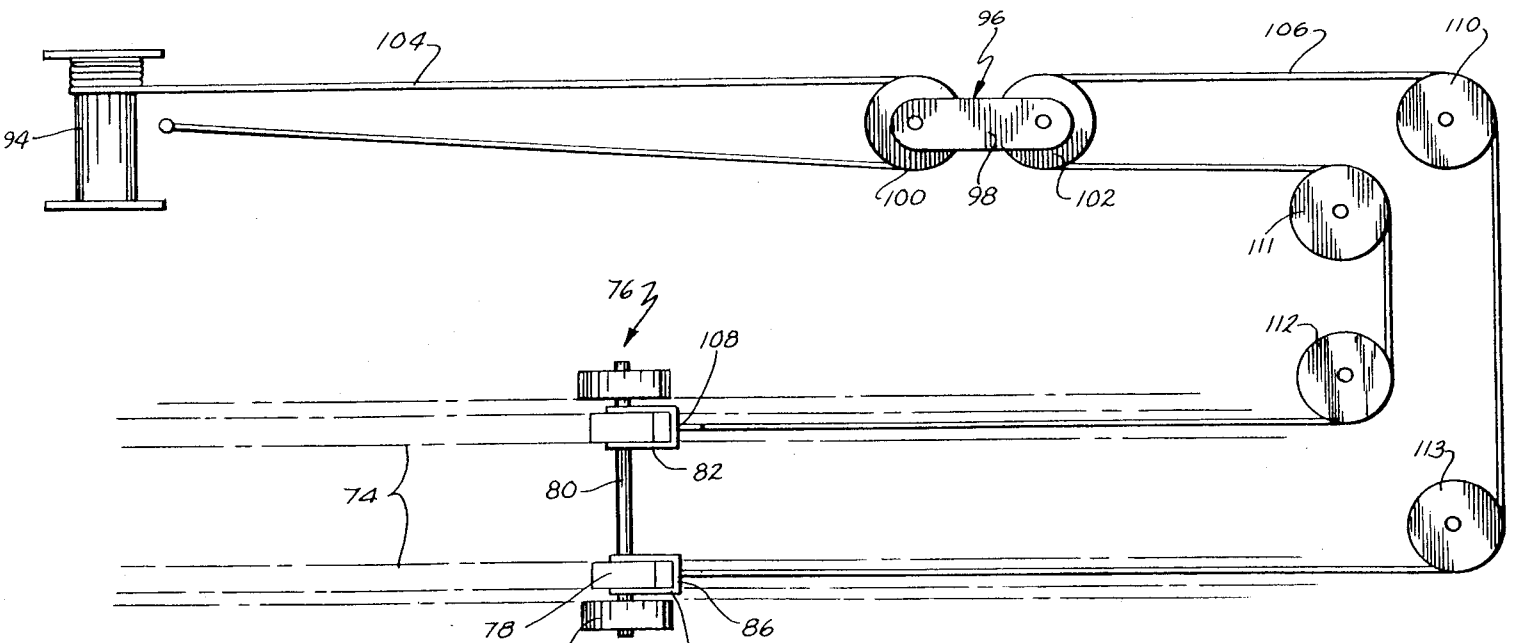
FIG. 5 is a schematic, top, plan view showing the drive or winch and cable portions of the A-frame erection subassembly.

A roller or carriage assembly 76 spans rails 74 and engages with A-frame 16. As shown in FIGS. 4 and 5, roller assembly 76 includes a shaft 80 having a pair of track engaging rollers 78 rotatably mounted thereon which ride along the upper surface of rails 74. Each roller lies within the interior of a rectangular-shaped carriage or roller frame 82 which is also attached to shaft 80. Frame 82 is defined by two side plates 84 and by a front plate 86 (see FIG. 5). Attached to each side plate 84 is a guide flange 88. Guide flanges 88 extend below the level of track engaging rollers 78. When the roller assembly is placed on track 72, the guide flanges extend along the sides of each of rails 74, thereby keeping roller assembly 76 on the track.

Roller assembly 76 also includes a pair of A-frame engaging rollers 90 which are rotatably mounted on the ends of shaft 80 such that the two track engaging rollers 78 are positioned between the two A-frame engaging rollers. Rollers 90 roll along triangular-shaped flanges 92 which are attached to the legs of A-frame 16 (see FIG. 3). Flanges 92 provide a continuous surface upon which rollers 90 ride as the width between the legs of the A-frame increases due to the divergence of those legs from the apex to the base. As an alternative, the roller assembly could have only one pair of rollers which would engage both the rails 74 and the A-frame flange 92.

The A-frame erection system further includes a drive means for moving the roller assembly along track 72 and derrick A-frame flange 92. As shown in FIG. 5, the drive means includes a winch 94 which is attached to rear cross base member 58 and a pulley block 96 having a block frame 98 and first and second pulleys 100 and 102, respectively. A first cable 104 operatively connects winch 94 to first pulley 100. A second cable 106 operatively connects pulley block 96 to roller assembly 76. The ends of cable 106 are each attached to an aperture 108 located in the front cross plate 86 of one of the carriage frames 82. The cable extends to and around second pulley 102. In the alternative, the pulley block could have only one pulley rotatably mounted thereto and could have a cable connected directly to the block frame of the pulley block and to the winch. In another alternative, the pulley block and the second cable could be eliminated completely from the system and a first cable could be attached directly to roller assembly 76.

Cable 106 is wrapped around auxiliary pulley assemblies 110, 111, 112 and 113. The auxiliary pulley assemblies change the direction of cable 106, thereby permitting the winch and cable system to be confined within the area of base frame 52. Pulleys 110–113 also balance the pull forces applied to each end of the roller assembly. This eliminates or limits skewing or mistracking of assembly 76.

In operation, roller assembly 76 is initially positioned at the lower forward end of track 72 when the derrick frame is in its collapsed, transporting position, as shown by the solid lines in FIG. 2. In this position, roller assembly 76 fits into the wedge formed by the intersecting angles of the flat surfaces of the derrick flanges 92 and the upper surface of rails 74. To raise the A-frame, winch 94 reels in cable 104 which in turn pulls pulley block 96 toward the winch. This action in turn pulls roller assembly 76 up the track and toward the pivoted end of the A-frame. Pulling roller assembly 76 along the track wedges that assembly under the A-frame and forces the A-frame engaging rollers 90 to roll along the flanges 92 of the A-frame. This wedging action rotates the A-frame about its pivoted lower end, thereby raising it. Winch 94 is activated until the A-frame is raised to its erected, operating position. The A-frame is lowered by reeling out cable 104. A spring may be used to start rotation of the A-frame upon release of cable 104. Also, the frame may be manually pushed past its center position.

The derrick frame erection system of the present invention eliminates the need to use overhead erection cables and pulleys, such as cable 29 as shown in FIG. 1. The need to use auxiliary erecting strut 30 as shown in FIG. 1 is also eliminated because of the mechanical advantages occurring between the cable forces and the A-frame weighted to be raised. Further, pulley block 96, pulley 102 and cable 106 operate to balance the pull forces applied at each track engaging roller 78.

DERRICK FRAME SUPPORT AND LOCKING MECHANISM

Figure 6:
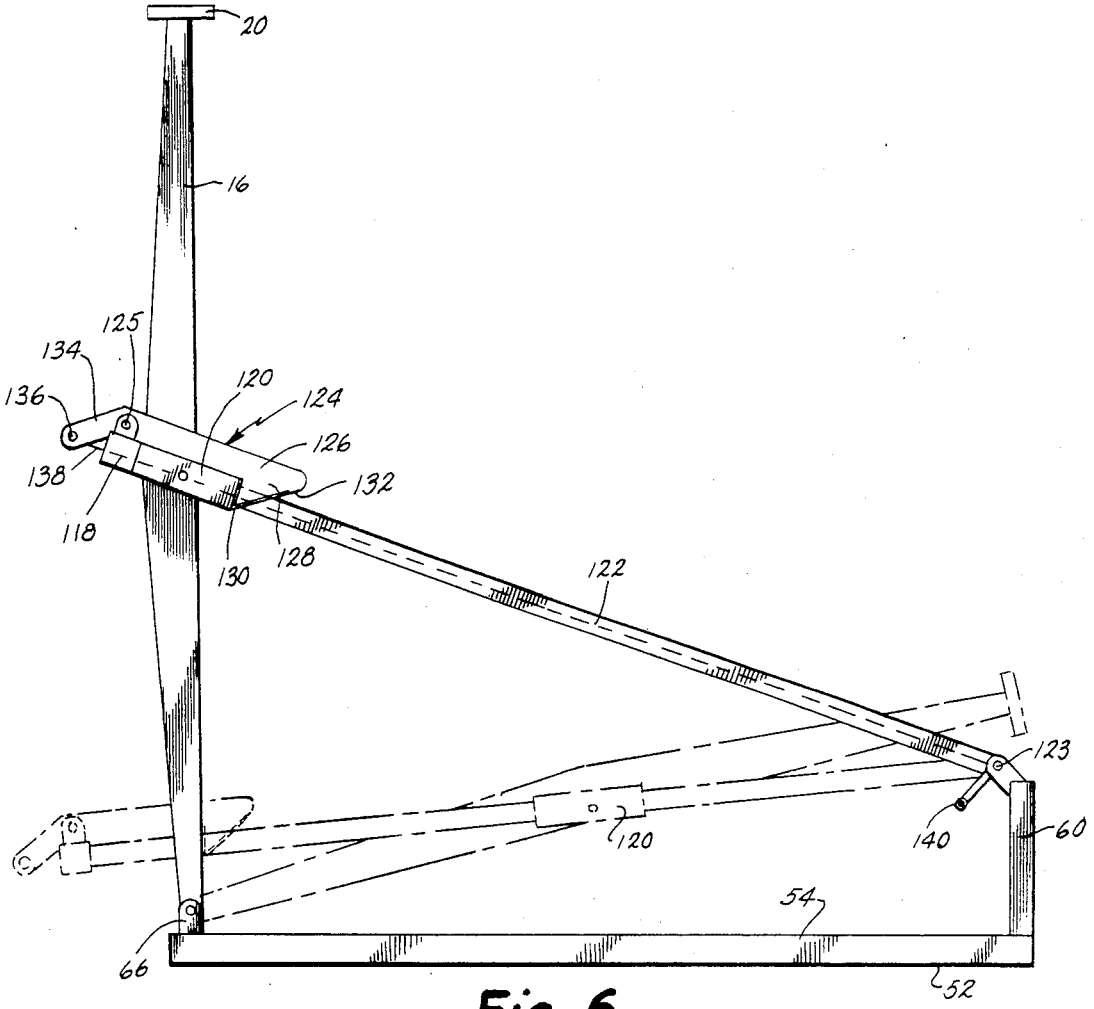
FIG. 6 is a side, elevational view showing the A-frame support braces and locking mechanism in accordance with the present invention.

The derrick frame brace or support system and locking mechanism for securing the frame in the erected position is another improvement to the derrick assembly which is disclosed in FIG. 1. As shown in FIG. 6, the improvement includes sleeves 120 which are pivotally attached to A-frame 16 and a pair of support braces 122 which are pivotally mounted to the upper ends of front struts 60 at pivot shafts 123. Preferably, support braces 122 have hollow interiors. The free end of each support brace 122 is inserted into and through sleeve 120. An end cap 118 having an outer diameter larger than the inner diameter of sleeve 120 is affixed to the end of the support brace in order to prevent the support brace from sliding out of sleeve 120.

A latch 124 is pivotally mounted to end cap 118 at pivot point 125. Latch 124 has a body 126 which is rectangular in shape and which extends toward the pivoted base of brace leg 122. A wedge-shaped or hook portion 128 extends perpendicularly from the free end of body 126 and has an inner face 130 which is perpendicular to the longitudinal axis of brace 122 and an outer face 132 which is acutely angled with respect to the longitudinal axis of brace 122. The distance between end cap 118 and inner face 130 is the same as or slightly greater than the longitudinal length of sleeve 120.

A tail lever 134 having a hole 136 at one end is attached to the pivoted end of latch 124 and extends outwardly and downwardly therefrom. A latch disengaging cable 138 is secured at one end to hole 136. Cable 138 is then inserted through the top of end cap 118 and through the hollow interior of brace 122. The other end of cable 138 is wrapped around brace pivot shaft 123. A crank 140 is rotatably connected to rotatable pivot shaft 123.

In operation, raising A-frame 16 to its erected, operating position simultaneously raises brace leg 122 which slidably engages with the A-frame via sleeve 120. The latching mechanism then engages with sleeve 120 once the A-frame is in its erected, vertical position. As the A-frame is raised, brace leg 122 slides through sleeve 120. Sleeve 120 pivots about its pivotal mounting so as to align its longitudinal axis with the longitudinal axis of the rising brace leg 122. As the A-frame erection process continues, the leading edge of sleeve 120 eventually comes into contact with the angled outer surface 132 of latch 124. This contact pushes latch 124 upward about its pivotal mounting such that the latch slides over the leading edge of the sleeve. Latch 124 continues to slide over sleeve 120 as support brace 122 slides through the sleeve. When the A-frame is vertical, sleeve 120 contacts end cap 118 which prevents any further sliding of brace 122 through the sleeve. At this point, the trailing edge of sleeve 120 passes the inner face 130 of latch 124. Latch 124 then falls by gravity back into place behind sleeve 120. Sleeve 120 is now securely engaged between end cap 118 and sleeve engaging member 128 which locks the A-frame into its erected, operating position.

To disengage the latching mechanism, crank 140 is turned which winds in the latch disengaging cable 138. Winding in the cable pulls on the free end of the tail lever 134 which in turn raises latch 124 about its pivot 125. When latch 124 is raised sufficiently, the sleeve engaging member 128 will clear the trailing edge of sleeve 120. At this point, brace leg 122 is free to slide through sleeve 120. A-frame 16 can then be lowered to its collapsed, transporting position, as shown by the dash lines in FIG. 6.

The brace and latch mechanism of the present invention provides a simple and positive lock to retain the A-frame in an upright position. The lock is activated by gravity, and this enhances the reliability of its operation. The release cable is enclosed inside the brace, and this protects it from damage or from being tangled with other lines or obstructions. Further, the locking mechanism can be located beyond the reach of the operator because the operator does not have to actually handle the locking mechanism. This permits support brace 122 to support the upper half of the A-frame which thus eliminates the need for auxiliary support cables or braces.

CABLE SLACKENING COMPENSATION SYSTEM

The derrick structure of the present invention supports a boom assembly and hook hoisting mechanism similar to that shown in FIG. 1. FIG. 1 illustrates a hook hoisting system which includes a winch 150 attached to lower cross bar 68 of the A-frame. A hoisting cable 152 extends from winch 150 upwardly along the vertical axis 148 of A-frame 16 to and over a pulley (not shown) rotatably supported on pivot shaft 154 of trunnion assembly 22. The cable then extends outwardly parallel to boom hoisting section 24 and over a pulley 156 supported on a bracket 158 disposed on the end of the hoisting boom section 24. A hook 160 is attached to the end of the cable 152.

As the A-frame of the FIG. 1 assembly is lowered, hoist cable 152 wraps around the pulleys and winch. This shortens the distance or length of the cable between the pulleys and the hook. Because the cable is fixed at one end to winch 150, the hooked end 160 of the cable retracts toward boom hoisting section 24. If the amount of cable retraction is greater than the original length of the cable hanging below boom hoisting section 24, the hook will jam into pulley 156, possibly causing cable 152 to snap.

Figure 7:
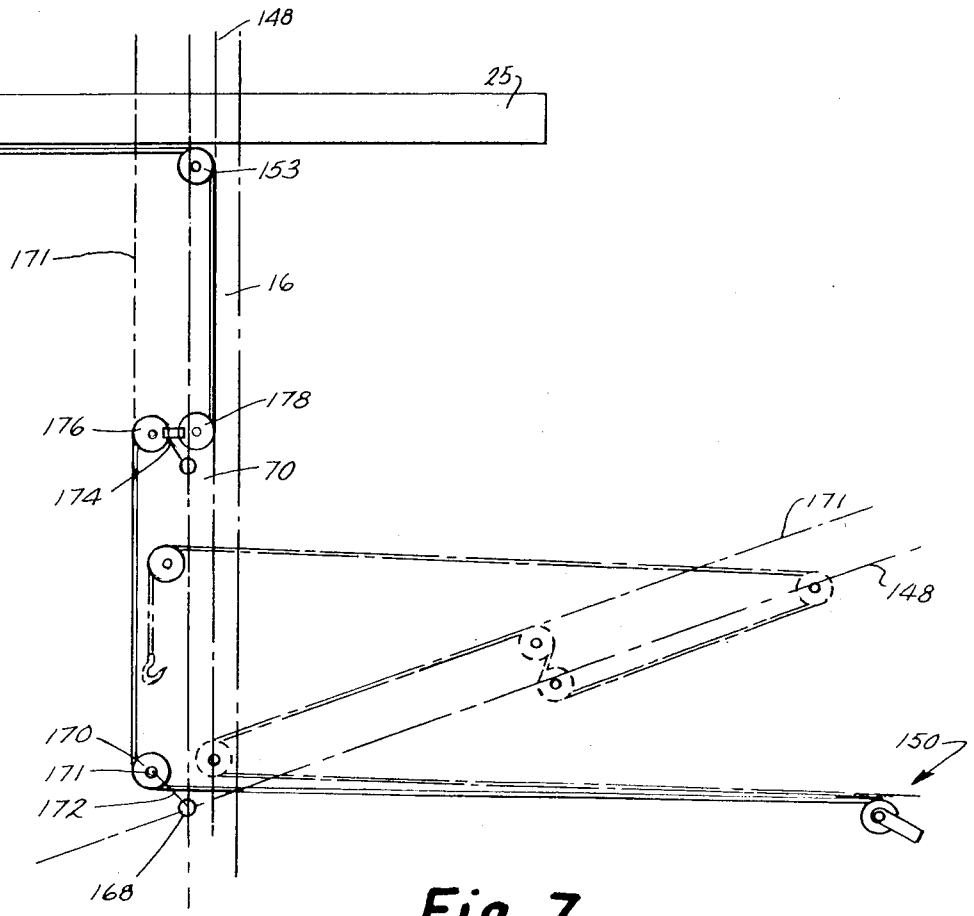
FIG. 7 is a schematic, side, elevational view showing the cable slackening compensation system in accordance with the present invention.
Figure 8:
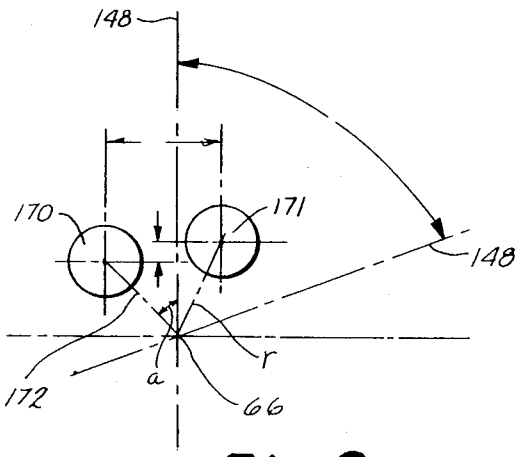
FIG. 8 is a schematic illustration showing a portion of the cable slackening compensation system.

FIGS. 7 and 8 illustrate the cable slackening system in accordance with the present invention which compensates for the cable wrapping effect which occurs when the A-frame is lowered and which thereby prevents the possibility of hook 160 retracting into pulley 156. In the cable slackening system of the present invention, hoisting winch 150 is fixedly secured to front cross brace member 56, rather than to the A-frame itself. Hoisting cable 152 is unreeled from winch 150 and extends to and around a guide or compensation pulley 170 which is rotatably mounted to a support arm 172 which in turn is connected to lower cross brace 68 of A-frame 16. Support arm 172 is attached to cross brace 68 such that axis 171 of pulley 170 is parallel to and offset from A-frame vertical axis 148. The cable then extends upwardly to and around a first pulley 176 and a second pulley 178 on A-frame 16. Cable 152 then continues along vertical axis 148 and pulley 153 and pulley 156. Pulley 153 is as shown in U.S. Pat. No. 4,068,762. Hook 160 is attached to the end of cable 152.

In operation, pulley 170 rotates through the arc defined by the radius r of support arm 172 as A-frame 16 is rotated about its pivot point 66 from a vertical position to a lowered position (see FIG. 8). As pulley 170 follows the arc traced by the support arm, it moves upward and forward, as seen in FIG. 8, thereby shortening the distance between pulley 170 and winch 150. The resulting slack in cable 152 compensates for the wrapping of that cable around the pulleys. The amount of slackening is determined by the length of support arm 172 and the angle "a" between the longitudinal axis or radius r defined by support arm 172 and vertical axis 148. The cable slackening system of the present invention compensates for the wrapping of cable 152 around the pulleys, thereby eliminating the possibility of the hooked end becoming jammed in boom pulley 156.

ALTERNATIVE A-FRAME ERECTION SUBASSEMBLY

An alternative erection mechanism for the A-frame is illustrated in FIGS. 9–12 and generally designated 210. The alternative erection subassembly replaces the roller and carriage subassembly and the brace structure described above. As in the previous embodiment, the lower end of A-frame 16 is pivoted to pivot mounting 66 secured to members 54 of the base frame. A pair of elongated tubular braces 212 have ends 214 pivoted to forward struts 60 by pivot pins or bolts 216. As best seen in FIGS. 10 and 12, each brace encloses or houses an elongated lead screw 218. Each lead screw 218 is supported within its respective brace by a suitable thrust bearing and rotation bearing. Each lead screw 218 includes a shaft 220 extending out of the lower end of each brace 214. During the erection operation, as described below, the lead screws are maintained in tension and the braces are in compression or column loaded. This permits smaller lead screws to be used since they are stressed in tension and not compression. When the derrick picks up a load, the braces are subject to tension and compression.

As seen in FIG. 12, each brace defines an elongated slot 224 which faces a leg 226 of the A-frame schematically illustrated in FIGS. 10 and 12. An internally threaded drive member 228 rides on and is threadably engaged by lead screw 218. As lead screws 218 are rotated, drive members 228 will move in unison along the lead screws. Secured to each drive member 228 is a flat or plate-like connecting element 230. Element 230 extends through slot 224 defined by brace 212. Secured to connecting element 230 is a flange 232. Extending from flange 232 and toward a leg 226 of the A-frame is an elongated pivot shaft 234. Pivot shaft 234 extends through a bore defined by a pivot boss 236. Pivot bosses 236 are secured to legs 226 of the A-frame.

An electric motor 240 is mounted on one of the braces 212 adjacent one of the pivot pins 216 (FIG. 10). Motor 240 includes a drive shaft 242 and a drive sprocket 244. A driven sprocket 246 is nonrotatably secured to shaft 220 of lead screw 218. Sprockets 242, 246 are interconnected by an endless roller chain 248. Each of the shafts 220 of the lead screws 218 also includes a connecting sprocket 250. Sprockets 250 are interconnected by an endless drive transmission member or endless chain 252. Rotation of sprocket 242 causes rotation of shaft 220 of one of the lead screws 218. As a result, both lead screws 218 are rotated through sprockets 250 and chain 252. Rotation of the lead screws 218 through motor 240 causes the drive members 228 to move towards or away from ends 214 of the braces in unison. In the alternative, an equivalent belt and pulley or gear drive arrangement could be substituted for the sprocket and chain arrangement.

Movement of the drive members 228 along lead screws 218 causes A-frame 16 to rotate about its pivots 66 between the collapsed position illustrated in solid lines and the erected position illustrated in phantom in FIG. 9. When rotation of the lead screws is stopped, the A-frame is anchored or locked in position. Each brace includes a stop 260 at its free end 262 to prevent overrunning of the drive members 228 on their lead screws. In addition, elongated slots 224 terminate an appropriate distance from each free end 262 of the braces to prevent overrunning of the drive members 228. This termination of the slots also provides increased strength near the ends of the braces. The top surface of the boom trunnion 20 (FIG. 9) can be leveled fore and aft by jogging or minor rotation of the lead screws 218 until the desired level position is achieved. The alternative A-frame erection system combines the functions of the erection drive and the support braces. The alternative structure also eliminates the need for separate locking mechanisms to secure the A-frame in the erected position.

Thus, it will be appreciated that the present invention provides a collapsible boom and foldable derrick hoist assembly of relatively compact size which can be readily raised and lowered. The A-frame erection systems are mechanically less complex and easier to operate than those heretofore provided. The system is more reliable and relatively easy to manufacture and install. The support brace and locking mechanism is adapted for use with any pivotal derrick frame. The mechanism automatically locks the derrick frame in the erected position. This substantially increases the ease of use of the overall assembly. The cable compensation system makes it possible to rotate booms or spars in general relative to other structures without causing the cable routed therethrough to retract. This prevents jamming of hooks and cable fittings and prevents breaking of the cable. The compensation system is easily installed on existing derrick and hoist assemblies.

In view of the foregoing description, those of ordinary skill in the art will undoubtedly envision various modifications which would not depart from the inventive concepts disclosed. It is expressly intended, therefore, that the foregoing description is illustrative of the preferred embodiment only and is not to be considered limited. The true spirit and scope of the present invention will be determined by reference to the appended claims.

The embodiments of the invention in which an exclusive property or privilege is claimed are defined as follows:

1. A collapsible derrick assembly, comprising:
a base frame;
a derrick frame having a base pivoted to said base frame; and
derrick frame erection means for pivoting said derrick frame from a collapsed position to an erected position, said erecting means comprising:
an elongated brace having an end pivoted to said base frame;
an elongated lead screw supported by said brace;
a threaded drive member engaged by said lead screw for movement along said screw upon rotation of said screw;
pivot means connected to said drive member for pivotally connecting said drive member to said derrick frame;
drive means operatively connected to said lead screw for rotating said lead screw; and
a cable slackening means attached to said derrick frame for use in conjunction with a hoisting cable arrangement adapted for mounting on said derrick, said arrangement including a hoist cable, a winch and a plurality of guide pulley means on said derrick frame for compensating for the retraction of said hoisting cable which occurs as the result of said cable wrapping around its guide pulleys as the derrick frame is lowered from its erected position to its collapsed position.

2. A collapsible derrick assembly as defined by claim 1 wherein said derrick frame includes a pair of spaced legs, each leg having a lower end pivoted to a rear end of said base frame and wherein said end of said brace is pivoted to a forward end of said base frame.

3. A collapsible derrick assembly as defined by claim 2 further including another elongated brace, said another elongated brace having an end pivoted to said forward end of said base frame, another lead screw supported by said another brace, another drive member engaged by said another lead screw and means for pivotally connecting said another drive member to said derrick frame.

4. A collapsible derrick assembly as defined by claim 3 wherein each of said braces is an elongated tube, said tubes defining opposed, elongated slots.

5. A collapsible derrick assembly as defined by claim 4 wherein said legs of said derrick frame each include a boss defining a throughbore and wherein said pivot means each include a pivot shaft connected to a respective one of said drive members and extending through a respective one of said slots and into the throughbore of a respective one of said bosses.

6. A collapsible derrick assembly as defined by claim 5 wherein said drive means comprises:
a first sprocket secured to said lead screw;
a second sprocket secured to said another lead screw;
an endless drive transmission member extending around said first and second sprockets; and
a motor operatively connected to one of said lead screws.

7. A collapsible derrick assembly as defined by claim 1, wherein said cable slackening means includes an arm having an end thereof attached to said derrick frame and another end thereof having one of said guide pulleys rotatably mounted thereon, said arm being attached to said derrick frame such that the axis of said guide pulley is parallel to and offset from the pivot axis of said derrick frame, the radius and angle of offset being such that upon rotation of the derrick frame to its collapsed position, said guide pulley moves upward and laterally as it follows the arc traced by said support arm, whereby said movement of said pulley shortens the distance between said pulley and said winch, thereby causing a slackening of said cable which compensates for the wrapping of said cable around said guide pulleys.

8. Apparatus for erecting a derrick frame from a collapsed position to an operating position about a pivot located at the lower end of the derrick frame, the derrick frame supporting a plurality of guide pulleys and a hoisting cable engaging the guide pulleys, said apparatus comprising:
a base frame;
a pair of elongated braces, each brace having a free end and a lower end pivoted to said base frame;
a pair of lead screws, each lead screw being supported by one of said braces;

drive means operatively connected to said lead screws for rotating said screws;

a pair of internally threaded drive members within said braces, each drive member being threadably engaged by one of said lead screws for movement in unison along said lead screws; and derrick frame connecting means on each of said drive members for pivotally connecting said drive members to said derrick frame, each of said braces defining an elongated slot, each of said connecting means including an elongated pivot shaft secured to said drive member and extending through each of said slots.

9. Apparatus as defined by claim 8 wherein each of said braces includes a stop at the free end thereof.

10. Apparatus as defined by claim 9 wherein said drive means comprises:

a pair of sprockets, each sprocket nonrotatably secured to one of said lead screws;

an endless chain interconnecting said sprockets; and a motor operatively connected to one of said lead screws for rotating said screws.

11. Apparatus as defined by claim 8 further including cable slack compensating means on said derrick frame for automatically compensating for the retraction of the hoisting cable due to wrapping of the hoisting cable about the guide pulleys during movement of the derrick frame to its collapsed position and thereby eliminating the possibility of hook jamming in one of the pulleys.

12. Apparatus as defined by claim 11 wherein said cable slack compensating means comprises:

an arm having an end secured to said derrick frame; and a compensating pulley mounted on another end of said arm, said arm positioned so that the axis of the compensating pulley is parallel to and offset from the pivot axis of the derrick frame, the radius and angle of offset being such that the compensating pulley moves upward and laterally as it follows the arc traced by said arm.

* * * * *
* * * * *